US006458242B1

(12) United States Patent
Bokström

(10) Patent No.: US 6,458,242 B1
(45) Date of Patent: Oct. 1, 2002

(54) OZONE BLEACHING PROCESS USING OXALIC ACID ADDITION

(75) Inventor: Monica Bokström, Kovland (SE)

(73) Assignee: Valmet Fibertech Aktiebolag (SE)

( * ) Notice: Subject to any disclaimer, the term of this patent is extended or adjusted under 35 U.S.C. 154(b) by 0 days.

(21) Appl. No.: 09/786,741

(22) PCT Filed: Aug. 18, 1999

(86) PCT No.: PCT/SE99/01394

§ 371 (c)(1),
(2), (4) Date: Mar. 8, 2001

(87) PCT Pub. No.: WO00/14327

PCT Pub. Date: Mar. 16, 2000

(30) Foreign Application Priority Data

Sep. 9, 1998 (SE) ..... 9803052

(51) Int. Cl.[7] ..... D21C 9/153
(52) U.S. Cl. ..... 162/40; 162/65; 162/76
(58) Field of Search ..... 162/65, 76, 40, 162/38, 39, 37

(56) References Cited

U.S. PATENT DOCUMENTS 4,229,252 A 10/1980 Meredith ..... 162/65
4,372,812 A 2/1983 Phillips et al. ..... 162/40
5,462,641 A * 10/1995 Bergvist et al. ..... 162/40

FOREIGN PATENT DOCUMENTS

EP 564 443 10/1993
JP 54-55607 A * 5/1979 ..... 162/65
WO 93/23608 11/1993
WO WO-94/29512 * 12/1994 ..... 162/65

OTHER PUBLICATIONS

BASTA, J. et al; "Metal Management in TCF/ECF Bleaching", 1994 International Pulp Bleaching Conference, Vancouver, British Columbia, Jun. 13–16, 1994, pp. 29–32.
BASTA, J. et al; "Reducing Levels of AOX–Part 3, Lowering of Kappa No. Prior to $ClO_2$ Bleaching", Production of Bleach Chemical Pulp in the Future, International Pulp Bleaching Conference 1991, Stockholm, Sweden, Jun. 11–14, 1991, vol. 3, pp. 23–33.

* cited by examiner

*Primary Examiner*—Steve Alvo
(74) *Attorney, Agent, or Firm*—Lerner, David, Littenberg, Krumholz & Mentlik, LLP

(57) ABSTRACT

Processes are disclosed for bleaching pulp with ozone in an environmentally friendly bleaching plant. The processes include removing a first filtrate from the pulp, bleaching the treated pulp with ozone, washing the bleached pulp with a washing liquid to provide a washed bleached pulp and a second filtrate including oxalic acid, recycling the second filtrate to the pulp prior to the bleaching step, and transferring the first filtrate to the bleached pulp.

6 Claims, 1 Drawing Sheet

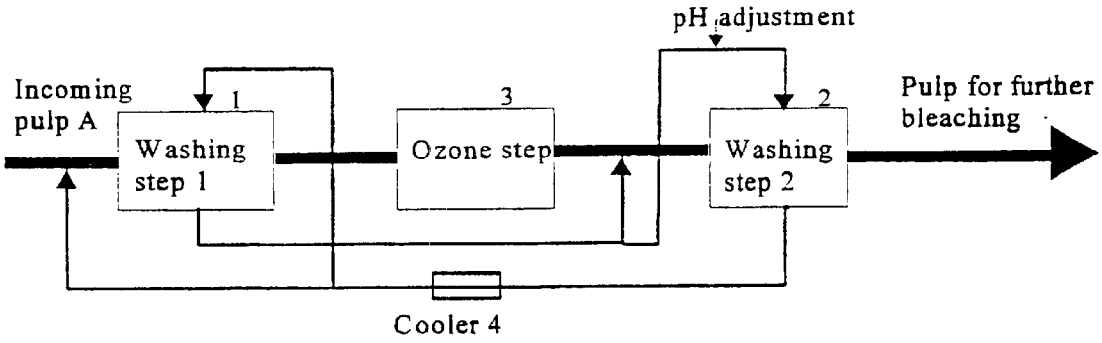
FIGURE

OZONE BLEACHING PROCESS USING OXALIC ACID ADDITION

FIELD OF THE INVENTION

The present invention relates to a method of efficient bleaching with ozone in an environment friendly bleaching plant comprising oxalic acid addition.

BACKGROUND OF THE INVENTION

The development of bleaching technique in order to provide more environment friendly processes has in principle followed two different lines of development, one towards the use of chlorine free chemicals, and one towards increased closing of the bleaching plants. Both lines of development have resulted in TCF sequences and so called light ECF sequences. In both of these sequences ozone bleaching is involved as an alternative. One problem with ozone bleaching, however, is that the selectivity evaluated as the pulp viscosity (cellulose degradation) in relation to the lignin release is generally quite poor. Therefore, even if the strength of the pulp per se is not changed to the same extent, this has led to comparatively low interest in ozone bleaching.

In TC and light ECF sequences, a peroxide step is usually included. This step demands the removal of certain metal ions, especially manganese ions. Efficient metal removing steps are either acid steps or complex forming steps, which are also active at low pH values (however, at a higher pH value compared to a pure acid step).

In bleaching, oxalic acid is formed, especially in oxygen delignification, in ozone steps, and in bleaching with chlorine dioxide. The combination of acid steps in which metals are washed out, and there is a high oxalic acid production has led to problems when closing the process, including, for example, calcium oxalate being deposited on the equipment. Calcium oxalate will precipitate at about a pH of from 4–to 8, a pH range in which, on the one hand, the complex forming effect is most efficient, while on the other hand, one which is easily obtained when mixing acid and alkaline bleaching filtrates.

In an article in J. PULP & PAPER SCI. 23(1997); 5 of J. Lidén, a mechanism is explained for the positive effect of Mg addition in oxygen and peroxide bleaching. Magnesium forms a complex with dissolved organic compounds, which in turn can dissolve Mn(II) and Fe(II). Thus, these divalent ions should be dissolved before they can be oxidized to higher valence states in the bleaching steps. The compounds referred to by Lidén et al are formed at alkaline pH.

In laboratory experiments the applicant has made comparisons between additions of different acids to the pulp for obtaining pH value of 3 before ozone bleaching, and the best selectivity was obtained with oxalic acid addition. A subsequent analysis of the different pulps disclosed that the pulp treated with oxalic acid maintained almost the entire original amount of both calcium and manganese ions, despite the low pH value and the fact that the selectivity was the best in this case.

Without being bound to any specific theory it is believed that the oxalic acid added to this step forms complexes with metal ions so that they cannot be washed out and also bind the deleterious divalent metal ions contributing to the decomposition of the ozone.

One object of the present invention is to thus improve the efficiency as compared to prior art, while at the same time the effluents from the bleaching process are diminished or at least are not increased.

SUMMARY OF THE INVENTION

In accordance with the present invention, this and other objects have now been realized by the invention of a process for bleaching pulp comprising removing water from the pulp thereby providing a treated pulp and a first filtrate, bleaching the treated pulp with ozone thereby providing a bleached pulp and oxalic acid, washing the bleached pulp with a washing liquid thereby providing a washed bleached pulp and a second filtrate including the oxalic acid, recycling the second filtrate to the pulp prior to the bleaching of the treated pulp, and transferring the first filtrate to the bleached pulp. Preferably, the recycling of the second filtrate comprises recycling the entire amount of the second filtrate.

In accordance with one embodiment of the process of the present invention, the removing of the water from the pulp comprises washing the pulp with a first washing liquid whereby the first filtrate comprises a first washing filtrate and the washing of the bleached pulp comprises washing the bleached pulp with a second washing liquid whereby the second filtrate comprises a second washing filtrate. In a preferred embodiment, the recycling of the second washing filtrate comprises diluting the pulp with the second washing filtrate. In another embodiment, the recycling of the second washing filtrate comprises utilizing at least a portion of the second washing filtrate as the first washing liquid.

In accordance with another embodiment of the process of the present invention, the transferring of the first filtrate to the bleached pulp comprises diluting the bleached pulp with the first filtrate.

In accordance with another embodiment of the process of the present invention, the transferring of the first filtrate to the bleached pulp comprises utilizing at least a portion of the first filtrate as washing liquid for the bleached pulp.

In accordance with another embodiment of the process of the present invention, the process includes adjusting the pH of the treated pulp to a pH of about 3. Preferably, the adjusting of the pH comprises adding a strong acid along with the second filtrate, preferably sulfuric acid.

According to the present invention, these objects are realized by a process in which bleaching filtrate, which is washed out of the pulp after the ozone step, is completely returned to the pulp before bleaching, the filtrate from the washing step before the ozone step is used as washing liquid after the ozone step, or alternatively, in the case where only dewatering is performed before the ozone step, the filtrate from the washing step after the ozone step is used as dilution liquid before the ozone step, for the formation of a closed loop.

In order to provide the correct pH level for ozone bleaching, i.e. about pH 3, a strong acid is also added, preferably sulphuric acid, together with said washing filtrate.

BRIEF DESCRIPTION OF THE DRAWING

The present invention will now be described with reference to the following detailed description, which, in turn, refers to the attached drawing, in which The FIGURE is a schematic representation of a process including a closed oxalic acid loop according to the present invention.

DETAILED DESCRIPTION

Referring to the FIGURE, it shows a schematic presentation of the method according to the present invention, and more specifically the part of this method which is referred to as the oxalic acid loop. Incoming pulp A is fed into a washing step 1, and then further to an ozone bleaching step 3, a subsequent washing step 2, and then to subsequent bleaching.

The pulp is diluted before washing step 1, which is located before the ozone step 3, with filtrate from washing step 2, situated after ozone step 3. The filtrate from washing step 2 is used also as washing liquid in washing step 1. The filtrate is acid, and only requires cooling (4) to an extent corresponding to the heat release in the ozone step (exothermic reaction). Filtrate from washing step 1 is used as washing liquid in washing step 2, and dilutes the pulp before washing step 2. In this way a closed loop is obtained, wherein high concentrations of oxalate and metal ions are circulating.

When filtrate from washing step 2 is added to the pulp in washing step 1 the content of oxalic acid/oxalate in the pulp is increased, resulting in the possibility that the recirculated metal ions, such as Mn and Fe, can be fed to the ozone step without negative effect on the ozone bleaching. A certain pH adjustment is made on the filtrate from washing step 1, such as with the aid of sulphuric acid. The pH will be lowest in washing step 2 because of the pulp reaction with ozone, and because of the pH adjustment with sulphuric acid, which facilitates the dewatering in the washing step and makes the washing-out of free metal ions effective before the pulp is transported to subsequent bleaching steps, which for example can be an alkaline peroxide step. That is, in peroxide bleaching it is important to keep the content of free Mn ions low. Compared to a conventional system the pulp can potentially contain higher amounts of manganese when it has been preceded by an ozone step with a high content of dissolved organic compounds, which can render manganese harmless by forming organic complexes with the ion.

A great advantage with the proposed process solution according to the present invention is that this part of the bleaching line is kept completely closed on the liquid side.

EXAMPLE

In order to evaluate a possible oxalic acid concentration in the effluent pulp the material balances have been studied for bleaching with the closed oxalic acid loop according to the present invention in comparison with a conventional HC ozone step.

In the example, hardwood pulp having a kappa number of 9 was introduced into the ozone (Z) step and it had a kappa number of 5.4 after ZE (ozone step followed by alkaline extraction) according to Table 3 in the CTP report "Formation of oxalic acid during ozone bleaching, origin and quantification". In the tests 5 kg $O_3$/t and 2.4 kg $O_3$/t was consumed. This results in an oxalate formation of 270 mg/kg pulp, and, converted into BDT, this equals 0.243 kg/BDT.

The oxalate content when using the method according to the present invention compared to the conventional method, increases from 0.014 to 0.050 kg/BDT, which is only a fraction of the amount formed.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A process for bleaching a metal-containing pulp, said process comprising a) combining said metal-containing pulp with an aqueous stream that includes oxalic acid;

b) removing water thereby providing a treated pulp and a first metal-containing filtrate;

c) bleaching said treated pulp with ozone thereby providing a bleached pulp and said oxalic acid;

d) transferring said first metal-containing filtrate to said bleached pulp;

e) washing said bleached pulp thereby providing a washed bleached pulp and a second metal-containing filtrate including said oxalic acid; wherein said aqueous stream comprises at least a portion of said second metal-containing filtrate.

2. The process of claim 1, wherein said aqueous stream comprises the entire amount of said second metal-containing filtrate.

3. The process of claim 1, wherein said combining of said metal-containing pulp with said aqueous stream comprises diluting said metal-containing pulp with a first portion of said second metal-containing filtrate.

4. The process of claim 3, wherein said combining of said metal-containing pulp with said aqueous stream further comprises washing with a second portion of said second metal-containing filtrate.

5. The process of claim 1, wherein said transferring of said first metal-containing filtrate to said bleached pulp comprises diluting said bleached pulp with said first metal-containing filtrate.

6. The process of claim 1, wherein said transferring of said first filtrate to said bleached pulp comprises utilizing at least a portion of said first filtrate as a washing liquid for said bleached pulp.

* * * * *